US010053975B2

(12) United States Patent
Tubel

(10) Patent No.: US 10,053,975 B2
(45) Date of Patent: Aug. 21, 2018

(54) WIRELESS ACTUATION AND DATA ACQUISITION WITH WIRELESS COMMUNICATIONS SYSTEM

(71) Applicant: Tubel, LLC., The Woodlands, TX (US)

(72) Inventor: Paulo Tubel, The Woodlands, TX (US)

(73) Assignee: TUBEL ENERGY, LLC, The Woodlands, TX (US)

( * ) Notice: Subject to any disclaimer, the term of this patent is extended or adjusted under 35 U.S.C. 154(b) by 296 days.

(21) Appl. No.: 14/339,202

(22) Filed: Jul. 23, 2014

(65) Prior Publication Data

US 2015/0027687 A1 Jan. 29, 2015

Related U.S. Application Data

(60) Provisional application No. 61/857,569, filed on Jul. 23, 2013.

(51) Int. Cl.
*E21B 47/12* (2012.01)
*E21B 17/10* (2006.01)

(52) U.S. Cl.
CPC ..... *E21B 47/12* (2013.01); *E21B 17/1078* (2013.01)

(58) Field of Classification Search
CPC ..... E21B 47/12; E21B 47/14; E21B 47/124; E21B 17/1078; E21B 17/10; E21B 17/1014; E21B 17/1021; E21B 17/1085
See application file for complete search history.

(56) References Cited

U.S. PATENT DOCUMENTS

2005/0028983 A1* 2/2005 Lehman ..... E21B 28/00 166/311
2008/0048455 A1* 2/2008 Carney ..... F03D 5/00 290/54
2011/0138903 A1* 6/2011 Large ..... E21B 17/1021 73/152.17
2011/0303413 A1* 12/2011 Fairbanks ..... C07C 4/02 166/302
2013/0020065 A1* 1/2013 Tubel ..... E21B 34/066 166/66.4
2013/0186645 A1* 7/2013 Hall ..... E21B 23/00 166/382

* cited by examiner

*Primary Examiner* — Taras P Bemko
*Assistant Examiner* — Manuel C Portocarrero
(74) *Attorney, Agent, or Firm* — Maze IP Law, PC

(57) ABSTRACT

A downhole wireless actuation based pipe lifting system with wireless communications and data acquisition capabilities for lifting casing from a well formation. The system may be deployed along a casing string with centralizers in the closed position to prevent any resistance that would be created by the centralizers. Upon reaching the proper location in the well, one or more pipe lifting systems may be actuated to lift the pipe from the well formation thereby providing a path for cement to flow around the casing. The system may collect, and store data before, during, and after the cementing process is performed, and may transmit the data wirelessly or by cable.

19 Claims, 2 Drawing Sheets

WIRELESS ACTUATION AND DATA ACQUISITION WITH WIRELESS COMMUNICATIONS SYSTEM

CROSS REFERENCE TO RELATED APPLICATIONS

This application claims the benefit of U.S. Provisional Application No. 61/857,569, filed on Jul. 23, 2013.

BACKGROUND OF THE INVENTION

The deployment of casing in a well is a difficult and time consuming operation. The process is even more difficult when the deployment is in sections of horizontal wells. The outside of casing is normally cemented to prevent the migration of downhole fluids throughout the well. The cementing process becomes very challenging when the casing is laying on the formation in the horizontal section of the well. The cement may not be able to migrate under the casing to create the required barrier.

Operators have used centralizers deployed as part of the casing string to prevent the pipe from settling at the lower side of the horizontal section of the well. However, these centralizers slow the deployment of the pipe and may get stuck in the well causing a significant delay and additional costs of deployment.

SUMMARY

A system is disclosed that is directed to a downhole wireless actuation based pipe lifting system with wireless communications and data acquisition capabilities. The system solves the problems with traditional centralizers by allowing casing to be freely deployed in the wellbore without any resistance that would be created by the centralizers. Upon reaching the proper location in the well, one or more pipe lifting systems can be actuated to lift the pipe from the well formation thereby providing a path for cement to flow around the casing. The system can collect data before, during, and after the cementing process is performed.

One embodiment of the invention comprises a housing deployable along a pipe string with a hermetically sealed interior and an outer assembly. The outer assembly has a plurality of arms that can be actuated downhole to lift the pipe from the well formation. An actuation module is disposed within the interior of the housing that can selectively engage and move the arms. Also disposed within the interior of the housing is an electronics module operatively in communication with the actuation module that can transmit a command to the actuation module to engage and move the arms. A sensor module is further housed at least partially within the interior of the housing that is operatively in communication with the electronics module. A communications module, disposed within the interior of the housing and operatively in communication with the electronics module, can receive and transmit signals. A power source is used to provide power to the system.

In another embodiment of the invention, a receiver module may be deployed to communicate with the communications module of the system and collect data, the receiver module comprising a receiver power source, a receiver electronics module disposed within the receiver housing and operatively connected to the receiver power source, and a receiver communications module operatively in communication with the receiver electronics module and disposed within the receiver housing.

Other embodiments of the invention include: The power source comprises at least one of a battery, a turbine, or a vibration harvest power module. The actuation module comprises at least one of a motor, a solenoid, or a pressure differential for moving the arms of the outer casing. The sensor module comprises at least one of a pressure or temperature sensor. The communications module comprises at least one of a wireless or wired means for communication such as acoustics, magnetics, electromagnetic, or pressure pulses.

BRIEF DESCRIPTION OF THE DRAWINGS

These and other features, aspects, and advantages of the system will become better understood with regard to the follow description, appended claims, and accompanying drawings where:

The various drawings supplied herein are representative of one or more embodiments of the present invention.

DESCRIPTION OF EMBODIMENTS

Figure 4:
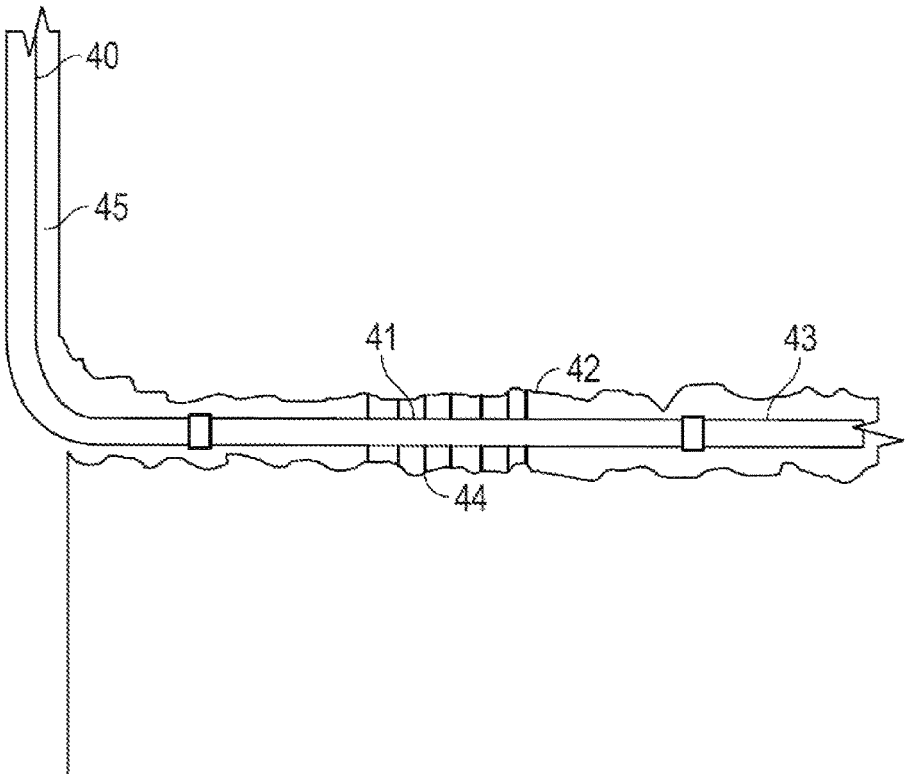
FIG. 4 is a drawing in partial perspective of a wellbore illustrating an exemplary embodiment of a representative actuated system downhole.

Referring now to FIG. 4, the system is adapted to be deployed along casing string 40 in wellbore 45 such as at ends 16. When actuated, arms 44 extend from the outer assembly 23 of the substantially tubular housing 41 to lift the pipe from the well formation 42 thereby providing a path for cement to flow around the casing string. The system can be deployed with arms in the closed position to prevent any resistance that would be created between the arms and the wellbore. Multiple systems may be deployed along casing string 43.

Figure 1:
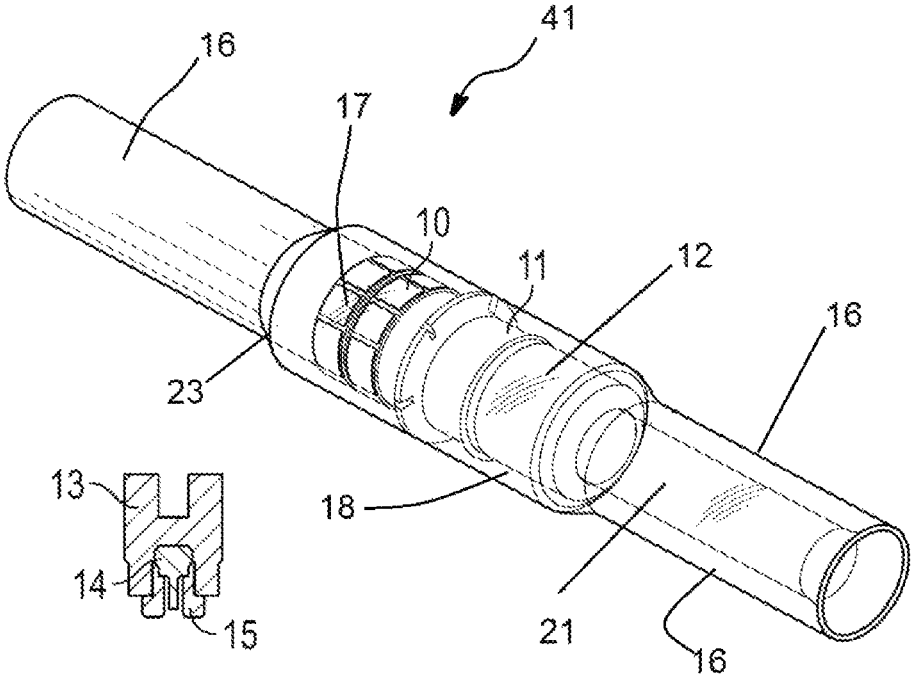
FIG. 1 is a cutaway planar view in partial perspective of an exemplary embodiment of a representative system with a detailed view of an exemplary sensor module.

Referring additionally to FIG. 1, power source 17 typically comprises batteries to provide power for all tasks to be performed by the system. In certain contemplated embodiments, the power source comprises at least one of a turbine or a vibrational harvest power module. Sensor module 11 typically comprises a pressure and temperature sensor, and typically acquires information from outer assembly 23 of the tubuluar housing 41 to monitor the cement curing process and the long term performance of the cement in the wellbore. A typical sensor configuration comprises sensor 14, sensor seat 15, and sensor retainer 13. Sensor module 11 is operatively in communication with electronics module 10 typically comprising a microprocessor with built in data acquisition hardware. In certain embodiments, data obtained from sensor module 11 may be collected and stored by electronics module 10, and then transmitted wirelessly by communications module 12.

Figure 3:
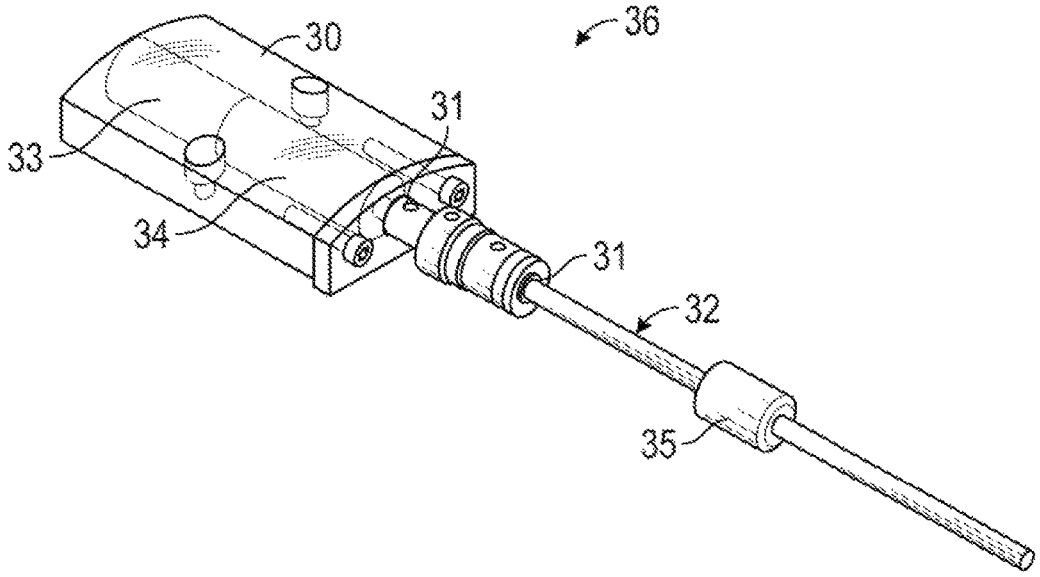
FIG. 3 is a cutaway planar view in partial perspective of an exemplary actuation module.

In an exemplary embodiment, the communications module 12 comprises two magnets connected by coiled wire which create a magnetic field for receiving an actuation signal and for communications. Magnetic fields are visualized, as lines of flux around a magnet. When an electrical conductor moves through lines of magnetic flux, a small current is induced in the conductor. If the conductor is in the form of a coil such that it crosses the lines of flux many times, the current generated is increased in direct proportion to the number of turns of wire in the coil. If the coil of wire is in a magnetic field and the lines of flux are distorted, current is generated just as if the wire were moved through the lines of flux around the magnets creating a current that can be converted into digital information. This approach would use two magnets where the poles face each other, with a coil placed between the magnets. This arrangement will focus the flux lines outward in a plane perpendicular to the axis of the system and inside the pipe. As the magnetic field is disturbed by another field inside the pipe, the amount of electrical current generated by the coil in the communications module will change. Electronics module 10 typically may detect any resulting change in current and engage the actuation module (see FIG. 3) to deploy the arms.

In certain embodiments, a vibration power harvest module uses a similar magnetic technique to generate power for the system, whereby the vibration power harvest module comprises a tuning fork housing a plurality of magnets, and a magnetic power module for generating a magnetic field, the magnetic power module comprising a plurality of magnets and at least one coil. As the tuning fork housing a plurality of magnets vibrates, the magnetic field generated by the magnetic power harvest module is disturbed to generate electricity.

In certain embodiments, actuation can be achieved by inserting two magnets into a pup joint which is then deployed via cable, dart, or ball and pumped into the well from the surface. Once the magnets pass the communications module, the balanced magnetic field created by the communications module will be disturbed, creating two unique pulses that are converted by the electronics module into an actuation command communicated to the actuation module. In certain contemplated embodiments, actuation will be valid if the pressure downhole, measured by the sensor module, is above a pre-programmed value. Additionally, in certain contemplated embodiments, the actuation process can be bypassed if a sequence of interruptions of the magnetic field is performed.

Figure 2:
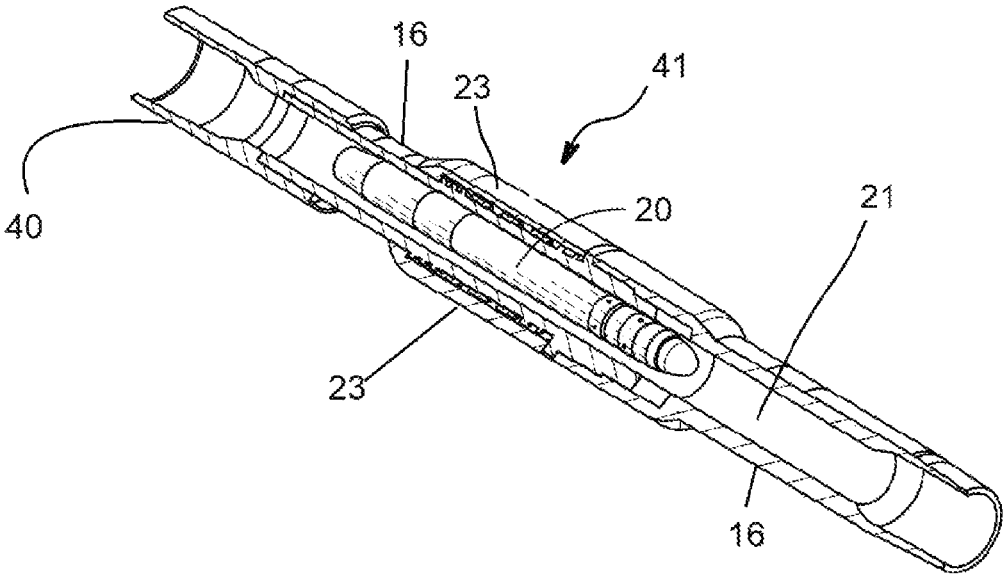
FIG. 2 is a cutaway planar view in partial perspective of a representative system with a receiver module.

The system may be actuated, referring additionally to FIG. 2, by receiver module 20. In certain typical embodiments, receiver module 20 comprises a receiver communications module further comprising a magnetometer and two magnets, as well as a receiver power source, receiver housing, and receiver electronics module. Receiver module 20 typically may actuate the system by pumping the receiver module through the casing string where it passes through fluid conduit 21, disturbing the magnetic field generated in the system via the communications module thereby creating pulses that are converted by the electronics module into an actuation command communicated to the actuation module. Data may also be transferred to the receiver module via a communications technique based on the changes of magnetic field inside the pipe detected by the receiver magnetometer, whereby such changes in the magnetic field are created by the system itself. The receiver module will assign a digital one or zero based on the measured higher or lower intensity of the magnetic field generated by the system's communication module. In certain embodiments, the system will provide real time communications when the receiver module is deployed in the wellbore on an electric line. In other embodiments, communication of data is accomplished through at least one of acoustic, electromagnetic, or magnetic means Referring additionally to FIG. 3, actuation module 36 typically comprises a motor assembly further comprising motor 33 that provides the torque to actuate the arms, gearhead retainer 30, bearing assembly 31, low friction threaded rod 32, planetary gear head 34, and traveling actuation element 35. The actuation module typically additionally comprises a feedback system to assure that the system has been actuated. In certain additional embodiments, the actuation module comprises at least one of a solenoid or wellbore fluid for actuation.

The foregoing disclosure and description of the inventions are illustrative and explanatory. Various changes may be made without departing from the spirit of the invention. Therefore, the spirit and scope of the appended claims should not be limited to the description of the exemplary embodiments contained herein.

What is claimed is:

1. A downhole wireless actuation and data acquisition based pipe lifting system with wireless communications, comprising:

a) a substantially tubular housing adapted to be deployed as part of a predetermined portion of a pipe string, the substantially tubular housing comprising:
   i) a fluid conduit in fluid communication with the pipe string;
   ii) an outer assembly, the outer assembly further comprising an exterior portion, an interior portion, and a plurality of arms, the arms comprising a closed position and an extended, actuated position, the arms adapted to selectively increase or decrease the resistance between a well formation and the substantially tubular housing, the arms further adapted to provide a path for a fluid to flow around the casing when the arms are in the extended, actuated position; and
   iii) a hermetically sealed interior disposed intermediate the fluid conduit and the inner portion of the outer assembly;

b) a power source disposed proximate an outer circumference of the substantially tubular housing;

c) an actuator disposed within the interior of the substantially tubular housing, the actuator adapted to selectively engage and move an arm of the plurality of arms from the closed position, which helps prevent resistance between the plurality of arms and the wellbore, into the actuated position to lift the pipe string with respect to the wellbore;

d) an electronics module disposed within the interior of the substantially tubular housing and operatively in communication with the power source and with the actuator;

e) a sensor housed at least partially within the interior of the substantially tubular housing and operatively in communication with the electronics module; and f) a transmitter disposed within the interior of the substantially tubular housing and operatively in communication with the electronics module, wherein the actuator comprises:
   a motor operatively coupled to the plurality of arms;
   a gearhead retainer;
   a bearing assembly;
   a low friction threaded rod;
   a planetary gear;
   a traveling actuator; and
   an actuator feedback sensor.

2. The downhole wireless actuation and data acquisition based pipe lifting system with wireless communications of claim 1, wherein the power source comprises a battery, a turbine, or a vibration harvest power module.

3. The downhole wireless actuation and data acquisition based pipe lifting system with wireless communications of claim 1, wherein the actuator comprises a motor, a solenoid, or a pressure differentiator.

4. The downhole wireless actuation and data acquisition based pipe lifting system with wireless communications of claim 1, wherein the sensor comprises a sensor for measuring a borehole parameter or a production parameter, a pressure sensor, or a temperature sensor.

5. The downhole wireless actuation and data acquisition based pipe lifting system with wireless communications of claim 1, wherein the fluid comprises cement.

6. The downhole wireless actuation and data acquisition based pipe lifting system with wireless communications of claim 1, wherein the transmitter comprises a wireless transmitter or a wired transmitter.

7. The downhole wireless actuation and data acquisition based pipe lifting system with wireless communications of claim 6, wherein the wireless transmitter comprises an acoustic transmitter, a magnetic transmitter, an electromagnetic transmitter, or a pressure pulse transmitter.

8. The downhole wireless actuation and data acquisition based pipe lifting system with wireless communications of claim 1, wherein the transmitter comprises a magnetic field generator.

9. The downhole wireless actuation and data acquisition based pipe lifting system with wireless communications of claim 1, further comprising a receiver adapted to communicate with the transmitter, the receiver comprising:

a) a receiver housing adapted to be insertable into a well within the pipe string and sized to pass through the fluid conduit of the substantially tubular housing;
b) a receiver power source;
c) a receiver electronics module disposed within the receiver housing and operatively in communication with the receiver power source; and
d) a receiver communications module disposed within the receiver housing and operatively in communication with the receiver electronics module.

10. The downhole wireless actuation and data acquisition based pipe lifting system with wireless communications of claim 9, wherein the receiver communications module comprises an acoustics receiver, a magnetic receiver, an electromagnetic receiver, or a pressure pulse receiver.

11. The downhole wireless actuation and data acquisition based pipe lifting system with wireless communications of claim 9, wherein the receiver communications module comprises:

a) a magnetic field generator; and
b) a magnetometer.

12. The downhole wireless actuation and data acquisition based pipe lifting system with wireless communications of claim 1, wherein the power source comprises a vibration harvest power module, further comprising:

a) a magnetic field power generator, the magnetic field power generator comprising:
i) a plurality of magnets; and
ii) a coiled wire; and
iii) a tuning fork, the tuning fork comprising a plurality of magnets configured to generate electricity by vibrating and disturbing a magnetic field generated by the magnetic power module.

13. A downhole wireless actuation and data acquisition based pipe lifting system with wireless communications, comprising:

a) a pipe lifting system, comprising:
i) a substantially tubular housing adapted to be deployed as a portion of a casing string, the substantially tubular housing comprising:
(1) an outer assembly comprising a plurality of arms adapted to selectively extend from or withdraw back to the outer assembly to selectively lift the pipe lifting system with respect to a wellbore into which the pipe lifting system is deployed, the arms further adapted to provide a path for a fluid to flow around the casing string when the arms are in the extended, actuated position; and
(2) a fluid conduit defining a hermetically sealed interior disposed intermediate a predetermined portion of the fluid conduit and an inner portion of the outer assembly;
ii) a power source disposed within the hermetically sealed interior;
iii) an actuator disposed within the hermetically sealed interior, the actuator adapted to selectively engage and move a predetermined set of arms of the plurality of arms;
iv) a controller disposed within the hermetically sealed interior, the controller operatively in communication with the power source and operatively in communication with the actuator;
v) a sensor housed at least partially within the hermetically sealed interior and operatively in communication with the electronics module; and
vi) a wireless communicator disposed within the hermetically sealed interior and operatively in communication with the controller; and
b) a receiver, comprising:
i) a receiver housing configured to be deployed within the casing string and pass through a portion of the fluid conduit;
ii) a magnetic field disruptor; and
iii) a receiver power source, wherein the actuator comprises:
a motor operatively coupled to the plurality of arms;
a gearhead retainer;
a bearing assembly;
a low friction threaded rod;
a planetary gear;
a traveling actuator; and
an actuator feedback sensor.

14. The downhole wireless actuation and data acquisition based pipe lifting system with wireless communications of claim 13, wherein the sensor comprises:

a) a sensor;
b) a sensor seat; and
c) a sensor retainer.

15. The downhole wireless actuation and data acquisition based pipe lifting system with wireless communications of claim 13, wherein the magnetic field disruptor comprises:

a) a magnetometer; and
b) a magnet.

16. A method of positioning a pipe string within a wellbore using a downhole wireless actuation and data acquisition based pipe lifting system, the downhole wireless actuation and data acquisition based pipe lifting system comprising a pipe lifting system comprising a substantially tubular lifter housing adapted to be deployed as a portion of a casing string, the substantially tubular housing comprising an outer assembly further comprising an exterior portion, an interior portion, and a plurality of arms adapted to selectively extend from or withdraw back to the exterior portion of the outer assembly to selectively lift the substantially tubular housing with respect to a wellbore into which the substantially tubular housing is deployed, the arms further adapted to provide a path for a fluid to flow around the casing string when the arms are in the extended, actuated position, and a fluid conduit defining a hermetically sealed interior disposed intermediate a predetermined portion of the fluid conduit and an inner portion of the outer assembly; a power source disposed within the hermetically sealed interior; an actuator disposed within the hermetically sealed interior, the actuator adapted to selectively engage and move a predetermined set of arms of the plurality of arms; a controller disposed within the hermetically sealed interior and operatively in communication with the power source and with the actuator; a sensor housed at least partially within the hermetically sealed interior and operatively in communication with the controller; and a wireless communicator disposed within the hermetically sealed interior and operatively in communication with the controller; and a receiver, comprising a receiver housing configured to be deployed within the casing string and pass through the fluid conduit; a magnetic field disruptor; and a receiver power source, the method comprising:

a) deploying the pipe lifting system to a predetermined location within the well bore with its arms sufficiently withdrawn into a closed position sufficient to allow the pipe lifting system to be positioned at the predetermined location within the well bore;

b) deploying the receiver through the casing string until it passes through the fluid conduit;

c) using the magnetic field disruptor to create a wireless signal detectable by the wireless communicator;

d) converting the detected wireless signal by the controller into an actuation command;

e) communicating the actuation command to the actuation module; and f) using the actuation module to extend the plurality of arms until the arms are sufficiently extended from the external portion of the housing to lift the pipe from the well formation and provide a path for a fluid to flow around the casing string, wherein the actuator comprises:

a motor operatively coupled to the plurality of arms;
a gearhead retainer;
a bearing assembly;
a low friction threaded rod;
a planetary gear;
a traveling actuator; and
an actuator feedback sensor.

17. The method of claim 16, wherein the fluid flowing around the casing string comprises cement.

18. The method of claim 16, further comprising:

a) deploying the receiver in the wellbore on an electric line; and b) using the sensor to gather data; and c) providing the gathered data in real time.

19. The method of claim 18, further comprising communicating the gathered data via acoustic transmission, electromagnetic transmission, or magnetic transmission.

* * * * *